US008612215B2

(12) United States Patent
Son et al.

(10) Patent No.: US 8,612,215 B2
(45) Date of Patent: Dec. 17, 2013

(54) METHOD AND APPARATUS TO EXTRACT IMPORTANT FREQUENCY COMPONENT OF AUDIO SIGNAL AND METHOD AND APPARATUS TO ENCODE AND/OR DECODE AUDIO SIGNAL USING THE SAME

(75) Inventors: Chang-yong Son, Yongin-si (KR); Bun-mi Oh, Yongin-si (KR); Ho-sang Sung, Yongin-si (KR); Ki-hyun Choo, Yongin-si (KR); Jung-hue Kim, Yongin-si (KR); Kang-eun Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1396 days.

(21) Appl. No.: 11/930,844

(22) Filed: Oct. 31, 2007

(65) Prior Publication Data

US 2008/0133223 A1 Jun. 5, 2008

(30) Foreign Application Priority Data

Dec. 4, 2006 (KR) ..... 10-2006-0121790

(51) Int. Cl.
*G10L 19/14* (2006.01)

(52) U.S. Cl.
USPC ..... 704/205; 704/219; 704/223; 704/225; 704/226; 704/500

(58) Field of Classification Search
USPC ..... 704/219, 223, 225, 500
See application file for complete search history.

(56) References Cited

U.S. PATENT DOCUMENTS

| | | | | |
|---|---|---|---|---|
| 5,596,675 | A | 1/1997 | Ishii et al. | |
| 7,630,882 | B2 * | 12/2009 | Mehrotra et al. | 704/205 |
| 2005/0102135 | A1 * | 5/2005 | Goronzy et al. | 704/213 |
| 2006/0149538 | A1 | 7/2006 | Lee et al. | |
| 2006/0206316 | A1 | 9/2006 | Sung et al. | |

FOREIGN PATENT DOCUMENTS

| | | |
|---|---|---|
| JP | 09-090989 | 4/1997 |
| KR | 20060078362 | 7/2006 |
| KR | 1020060099107 | 9/2006 |
| WO | 02091362 A1 | 11/2002 |

OTHER PUBLICATIONS

Srinivasan et al., "High-Quality Audio Compression Using an Adaptive Wavelet Packet Decomposition and Psychoacoustic Modeling", Apr. 1998, IEEE Transactions on Signal Processing, vol. 46, No. 4, pp. 1085-1093.*

Korean Office Action dated Dec. 20, 2007 issued in KR 2006-0121790.

International Search Report issued Feb. 21, 2008 in International Korean Application No. PCT/KR2007/005699.

(Continued)

*Primary Examiner* — Jakieda Jackson
(74) *Attorney, Agent, or Firm* — Stanzione & Kim, LLP

(57) ABSTRACT

A method and apparatus to extract an important frequency component of an audio signal and a method and apparatus to encode and/or decode an audio signal by using the same. The method of extracting an important frequency component of an audio signal includes converting an audio signal of a time domain into an audio signal of a frequency domain, selecting a frequency band having a harmonic feature from the converted audio signal of the frequency domain, and extracting an important frequency component from the selected frequency band having the harmonic feature.

21 Claims, 10 Drawing Sheets

(56) References Cited

OTHER PUBLICATIONS

Verma, T.S. et al. 'Sinusoidal Modeling Using Frame-Based Perceptually Weighted Matching Pursuits' In: Proceedings of IEEE International Conference on Acoustics, Speech, and Signal Processing. (ICASSP'99). May 3, 1999, vol. 2, pp. 981-984. See pp. 982 and 983.
Lahat, M. et al. A Spectral Autocorrelation Method for Measurement of the Fundamental Frequency of Noise-Corrupted Speech. IEEE Transactions on Acoustics, Speech, and Signal Processing. Jun. 1987, vol. 35, No. 6, pp. 741-750. See p. 748.
Purnhagen, H. et al. 'Sinusoidal Coding Using Loudness-Based Component Selection' In: Proceedings of IEEE International Conference on Acoustics, Speech, and Signal Processing, 2002 (ICASSP'02) May 13, 2002, vol. 2, pp. 1817-1820. See pp. 1817 and 1818.
Korean Notice of Allowance issued Sep. 3, 2008 in KR Application No. 10-2006-0121790.

* cited by examiner

METHOD AND APPARATUS TO EXTRACT IMPORTANT FREQUENCY COMPONENT OF AUDIO SIGNAL AND METHOD AND APPARATUS TO ENCODE AND/OR DECODE AUDIO SIGNAL USING THE SAME

CROSS-REFERENCE TO RELATED APPLICATIONS

This application claims the benefit of Korean Patent Application No. 10-2006-0121790, filed on Dec. 4, 2006, in the Korean Intellectual Property Office, the disclosure of which is incorporated herein in its entirety by reference.

BACKGROUND OF THE INVENTION

1. Field of the Invention

The present general inventive concept relates to a method and apparatus to extract an important frequency component of an audio signal and a method and apparatus to encode and/or decode an audio signal by using the same, and more particularly to a method and apparatus to provide a high quality audio signal by effectively compressing data to a low bit rate. The method of encoding and decoding data may be utilized in a telecommunication apparatus or a signal processing apparatus, such as a mobile phone, a computer, a portable device, a display device, a recording and/or reproducing device, etc., which compresses an audio signal at a high compression rate and decompresses an audio signal having a high quality sound.

2. Description of the Related Art

An MPEG audio is a standard format of ISO/IEC for high quality and efficient stereo encoding. Subband encoding based on 32 bands (band division encoding) and modified discrete cosine transformation (MDCT) are used in audio signal compression, and highly efficient compression can be realized using psychoacoustic characteristics. MPEG audio can be achieved having more high quality sound by using the above technology.

In the MPEG audio, in order to efficiently compress an audio signal, a perceptual encoding compression method is used to reduce the amount of encoding by omitting low sensitive detailed data and applying human sensing characteristics for perceiving signals. Moreover, the perceptual encoding compression method using the psychoacoustic characteristics in the MPEG audio uses minimum audible limits and mask characteristics in a quiet environment. The minimum audible limit in a quiet environment is a minimal level of human auditory perception, is related to a noise limitation of the human auditory perception in a quiet environment, and is changed according to sound frequencies. At a certain frequency, a sound larger than the minimum audible limit can be heard, but a sound smaller than the minimum audible limit cannot be heard. Moreover, a sensing limitation of a specific sound is changed according to another sound. This is called a masking effect. A frequency width causing the masking effect is called a critical band. In order to effectively utilize psychoacoustic characteristics such as the critical band, it is important to divide audio signals into frequency components. For this, a band is divided into 32 bands for subband encoding. Additionally, at this point, the MPEG audio utilizes a filter bank to reduce aliasing noise of the 32 bands.

The MPEG audio includes bit allocation using the filter bank and a psychological sound mode, and quantization. A coefficient generated by a MDCT result is compressed by using a psychoacoustic model-2 by allocating an optimized quantization bit. Since the psychoacoustic model-2 for allocating an optimized bit calculates the masking effect by using a fast Fourier transform (FFT) and a spreading function, a high level of complexity is required.

When compressing an audio signal to a low bit rate (below 32 kbps), the number of bits allocated for each signal is insufficient for quantizing and encoding all frequency components of the audio signal. Accordingly, perceptually important frequency components need to be effectively extracted and encoded.

In a conventional method of extracting the perceptually important frequency component, and compressing and encoding the extracted component, an important frequency component and a noise component are separated and encoded by considering a psychoacoustic aspect. Additionally, a frequency component is reduced so as to apply a psychoacoustic model for the reduced frequency component by considering an output energy according to a frequency band of an audio signal.

However, when a conventional encoding method is used, a relatively large number of bits are required to specify an important frequency component. Moreover, since an important valley portion has a low signal-to-masking ratio (SMR) and energy in a voice signal, it is not selected as an important frequency component. Therefore, there is a limitation in providing a perceptually excellent audio signal.

SUMMARY OF THE INVENTION

The present general inventive concept provides a method and apparatus to extract one or more important frequency components from a subband of an audio signal according to a harmonic feature of the subband of the audio signal.

The present general inventive concept provides a method and apparatus to encode an audio signal according to one or more important frequency components using a combination of a psychoacoustic model and a harmonic model, and a method and apparatus to decode the audio signal according to information on the one or more important frequency components.

The present general inventive concept provides a method and apparatus to encode or decode an audio signal according to an important frequency component having a level lower than a mask of a psychoacoustic model a perceptually excellent audio.

The present general inventive concept provides a perceptually excellent audio signal using a combination of a psychoacoustic model based extracting unit and a harmonic model based extracting unit.

Additional aspects and utilities of the present general inventive concept will be set forth in part in the description which follows and, in part, will be obvious from the description, or may be learned by practice of the general inventive concept.

The foregoing and/or other aspects of the present general inventive concept may be achieved by providing an apparatus to extract one or more important frequency component of an audio signal to encode the audio signal, comprising: an extracting unit to extract one or more important frequency components from a subband of an audio signal according to a harmonic feature of the subband of the audio signal, wherein the audio signal is encoded according to the extracted one or more important frequency components.

The extract unit may extract the one or more important frequency components from the subband of the audio signal according to a harmonic model when the subband includes the harmonic feature.

The extracting unit may extract the one or more important frequency components from the subband of the audio signal according to a psychoacoustic model when the subband does not include the harmonic feature.

The extracting unit may extract the one or more important frequency components from the subband of the audio signal according to a psychoacoustic model and a harmonic model when the subband includes the harmonic feature.

The extracting unit may extract a harmonic parameter from the one or more important frequency components, so that the audio signal is encoded according to the harmonic parameter.

The harmonic feature may include at least one of harmonic peaks, a harmonic period of harmonic frequency components, and autocorrelation corresponding to a harmonic period of a harmonic frequency.

The subband may include a first subband and a second subband, and the extracting unit extracts one or more first important frequency component as the one or more important frequency components from the first subband of the audio signal according to a harmonic model when the first subband includes the harmonic feature, and extracts one or more second important frequency components as the one or more important frequency components according to a psychoacoustic model when the second subband does not include the harmonic feature.

The subband may include a first subband and a second subband, and the extracting unit extracts one or more first important frequency component as the one or more important frequency components from the first subband of the audio signal according to a psychoacoustic model and a harmonic model when the first subband includes the harmonic feature, and extracts one or more second important frequency components as the one or more important frequency components according to the psychoacoustic model when the second subband does not include the harmonic feature.

The extracting unit may include a first path to extract one or more first frequency components as the one or more important frequency components from the subband according to a psychoacoustic model, and a second path to extract one or more second frequency components as the one or more important frequency components from the subband according to a harmonic model.

The extracting unit may extract in the second path the one or more second frequency components from the one or more first frequency components, as the one or more sub-important frequency components.

The extracting unit may include a first path to extract the one or more important frequency components from the subband according to a psychoacoustic model, and a second path to extract the one or more important frequency components from the subband according to a harmonic model, and the extracting unit may extract the one or more important frequency components select according to at least one of the first path and the second path.

The extracting unit may include a first path and a second path corresponding to a psychoacoustic model and a harmonic model, respectively and extracts the one or more important frequency components according to a combination of the first path and the second path.

The extracting unit may include a plurality of paths to extract the one or more important frequency components according to at least one of a psychoacoustic model and a harmonic model, and extracts the one or more important frequency components according to a combination of the plurality of paths.

The apparatus may further include a determination unit to determine the harmonic feature, so that the extracting unit extracts the one or more important frequency components according to a harmonic model when the determining unit determines that the harmonic feature exists in the subband of the audio signal.

The apparatus may further include a determination unit to generate an extracting mode to indicate that the subband of the audio signal of the frequency domain includes the harmonic feature, wherein the extracting unit extracts the one or more important frequency components.

The apparatus may further include a determination unit to determine whether the subband of the audio signal of the frequency domain includes the harmonic feature, and to generate an extracting mode, wherein the extracting unit extracts the one or more important frequency components from the subband of the audio signal according to a harmonic model and the extracting mode.

The apparatus may further include a converting unit to convert an input audio signal of a time domain into the audio signal of a frequency domain; and a determination unit to determine whether the subband of the audio signal of the frequency domain includes the harmonic feature, wherein the extracting unit extracts the one or more important frequency components from the subband of the audio signal according to a determination of whether the harmonic feature is included in the subband of the audio signal.

The apparatus may further include a converting unit to convert an input audio signal of a time domain into the audio signal of a frequency domain; and a dividing unit to divide the audio signal of the frequency domain into a plurality of subbands, and a determination unit to determine whether each of the subbands of the audio signal of the frequency domain includes the harmonic feature, and to generate an extracting mode, wherein the extracting unit extracts the one or more important frequency components from the subband of the audio signal according to a harmonic model and the extracting mode.

The extracting unit may extract one or more frequency components having a low signal to mask ratio (SMR) from the subband as the one or more important frequency components.

The extracting unit may extract one or more first frequency components having a signal greater than a mask of a psychoacoustic model and one or more second frequency components having a second signal smaller than the mask of the psychoacoustic model as the one or more important frequency components.

The foregoing and/or other aspects of the present general inventive concept may also be achieved by providing an apparatus to encode an audio signal, including an encoder to extract one or more important frequency components from a subband of an audio signal according to a harmonic feature of the subband of the audio signal, and to encode the audio signal according to the extracted one or more important frequency components.

The foregoing and/or other aspects of the present general inventive concept may also be achieved by providing an apparatus to decode an audio signal, including a decoder to decode an audio signal according to information on one or more important frequency components of a subband of the audio signal and information on a harmonic feature of the subband of the audio signal.

The foregoing and/or other aspects of the present general inventive concept may also be achieved by providing an apparatus to encode and/or decode an audio signal, including an encoder to encode an audio signal according to one or more important frequency components among frequency components of a subband of an audio signal according to a harmonic feature of the subband of the audio signal, and a decoder to decode the encoded audio signal according to information on the one or more important frequency components of the subband of the audio signal and information on the harmonic feature of the subband of the audio signal.

The foregoing and/or other aspects of the present general inventive concept may also be achieved by providing a method of an apparatus to encode an audio signal, the method including encoding an audio signal according to one or more important frequency components among frequency components of a subband of an audio signal according to a harmonic feature of the subband of the audio signal.

The foregoing and/or other aspects of the present general inventive concept may also be achieved by providing a method of an apparatus to decode an audio signal, the method including decoding an audio signal according to information on one or more important frequency components of a subband of the audio signal and information on a harmonic feature of the subband of the audio signal.

The foregoing and/or other aspects of the present general inventive concept may also be achieved by providing a method of an apparatus to encode and/or decode an audio signal, the method including encoding an audio signal according to one or more important frequency components among frequency components of a subband of an audio signal according to a harmonic feature of the subband of the audio signal, and decoding the encoded audio signal according to information on the one or more important frequency components of the subband of the audio signal and information on the harmonic feature of the subband of the audio signal.

The foregoing and/or other aspects of the present general inventive concept may also be achieved by providing a computer-readable medium containing computer-readable codes as a computer program to execute a method of an apparatus to encode an audio signal, the method including encoding an audio signal according to one or more important frequency components among frequency components of a subband of an audio signal according to a harmonic feature of the subband of the audio signal.

The foregoing and/or other aspects of the present general inventive concept may also be achieved by providing a computer-readable medium containing computer-readable codes as a computer program to execute a method of an apparatus to decode an audio signal, the method including decoding an audio signal according to information on one or more important frequency components of a subband of the audio signal and information on a harmonic feature of the subband of the audio signal.

The foregoing and/or other aspects of the present general inventive concept may also be achieved by providing a computer-readable medium containing computer-readable codes as a computer program to execute a method of an apparatus to encode and/or decode an audio signal, the method including encoding an audio signal according to one or more important frequency components among frequency components of a subband of an audio signal according to a harmonic feature of the subband of the audio signal, and decoding the encoded audio signal according to information on the one or more important frequency components of the subband of the audio signal and information on the harmonic feature of the subband of the audio signal.

The foregoing and/or other aspects of the present general inventive concept may also be achieved by providing an apparatus to extract one or more important frequency component of an audio signal to encode the audio signal, including an encoder to encode an audio signal according to a first important frequency component having a level lower than a mask of a psychoacoustic model and a second important frequency component having a level greater than the mask of the psychoacoustic model.

The encoder may extract the first important frequency component using a psychoacoustic model and extracts the second important frequency component using a harmonic model.

The foregoing and/or other aspects of the present general inventive concept may also be achieved by providing an encoder to extract a first important frequency component according to a harmonic model and a second important frequency component according to a psychoacoustic model, and to encode an audio signal according to the first and second important frequency components and information on the first important frequency component.

The foregoing and/or other aspects of the present general inventive concept may also be achieved by providing an encoder to extract one or more important frequency components from a subband of an audio signal according to a harmonic model and a psychoacoustic model, and encode the subband of the audio signal according to the extracted one or more important frequency component and information on a harmonic parameter of the harmonic model.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
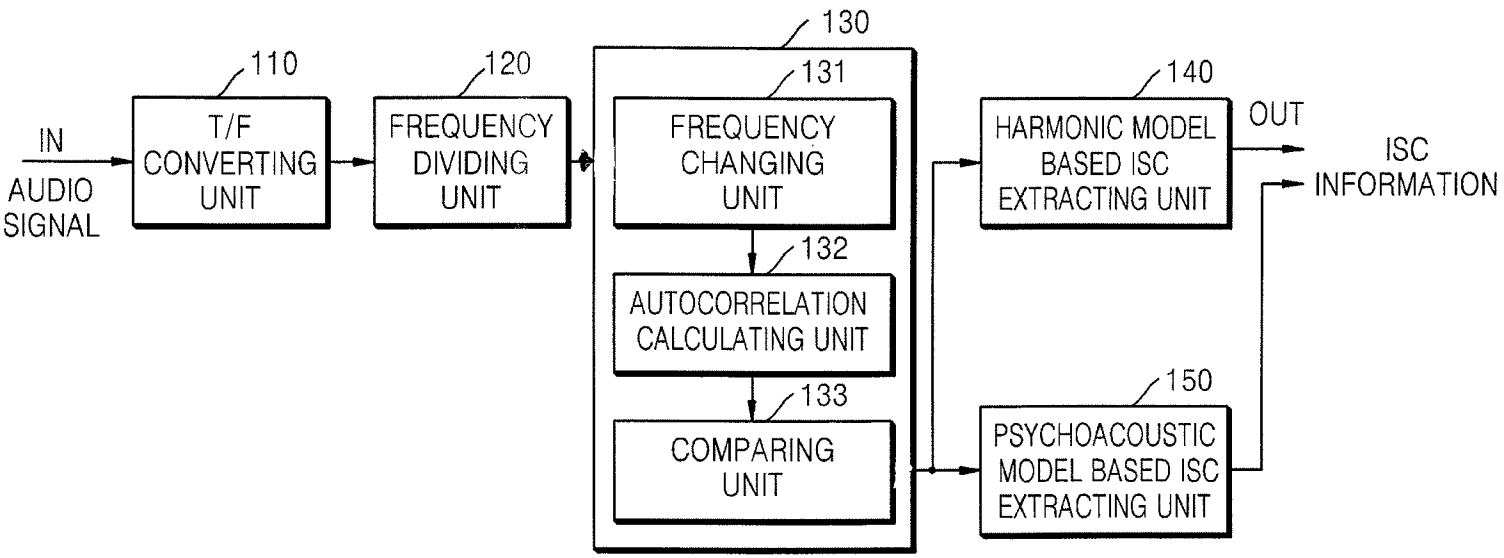
FIG. 1 is a block diagram of an apparatus to extract an important frequency component of an audio signal according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram of an apparatus to extract an important frequency component of an audio signal according to an embodiment of the present general inventive concept. The apparatus to extract the important frequency component includes a time/frequency (T/F) converting unit 110, a frequency dividing unit 120, a harmonic feature determining unit 130, a harmonic model based important spectral component (ISC) extracting unit 140, and a psychoacoustic model based ISC extracting unit 150. Here, the important frequency component (IFC) may be referred to as an important spectral component (ISC).

The T/F converting unit 110 converts an input audio signal of a time domain into an audio signal of a frequency domain. The input audio signal is divided into a plurality of frames each having a predetermined magnitude according to an inputted time interval. Then, each of the divided frames is converted into the audio signal of the frequency domain by the T/F converting unit 110. That is, the T/F converting unit 110 receives the audio signal of the time domain and converts the audio signal of the time domain into the audio signal of the frequency domain by performing modified discrete cosine transformation (MDCT) and a modified discrete sine transformation (MDST) on the audio signal of the time domain.

The frequency dividing unit 120 decomposes the audio signal of the frequency domain with respect to each of the frames into a plurality of subbands. Signals in a frequency domain, which correspond to one frame in a time domain, are classified as a frequency band. It is important in terms of encoding efficiency that an appropriate important frequency extracting mode is assigned to a signal component in each of the classified subbands. Whether a subband includes a harmonic feature is determined according to a characteristic of the subband. The harmonic feature may include a signal component corresponding to a harmonic signal. In a case of the subband having the harmonic feature, an important frequency component is extracted based on a harmonic model and/or a conventional psychoacoustic model because encoding can be performed with a smaller number of bits by using parameter extraction to specify the important frequency component.

The harmonic feature determining unit 130 determines whether the harmonic feature exists or not in each of the subbands by using a frequency changing method. The harmonic feature determining unit 130 includes a frequency changing unit 131, an autocorrelation calculating unit 132, and a comparing unit 133.

The frequency changing unit 131 changes the signals of the frequency domain of the respective subbands to be in parallel, the autocorrelation calculating unit 132 calculates and normalizes an autocorrelation value of each subband, and the comparing unit 133 compares the normalized autocorrelation value with a predetermined reference value.

The frequency changing unit 131 changes a starting frequency of each subband to be a starting point according to the frequency changing method. In order to accurately calculate a harmonic period of the harmonic signals, the changed frequency component may be adjusted to place a harmonic peak on the starting point, that is, to be in parallel.

The autocorrelation calculating unit 132 calculates the autocorrelation value for the harmonic period at each subband by performing Inverse Fourier transformation on a frequency changed spectrum and normalizes the autocorrelation value into a first signal, for example, 0, or a second signal, for example, 1. As the autocorrelation value becomes larger, a voicing level of the audio signal becomes larger, and as the autocorrelation value becomes smaller, the voicing level of the audio signal becomes smaller.

Figure 2:
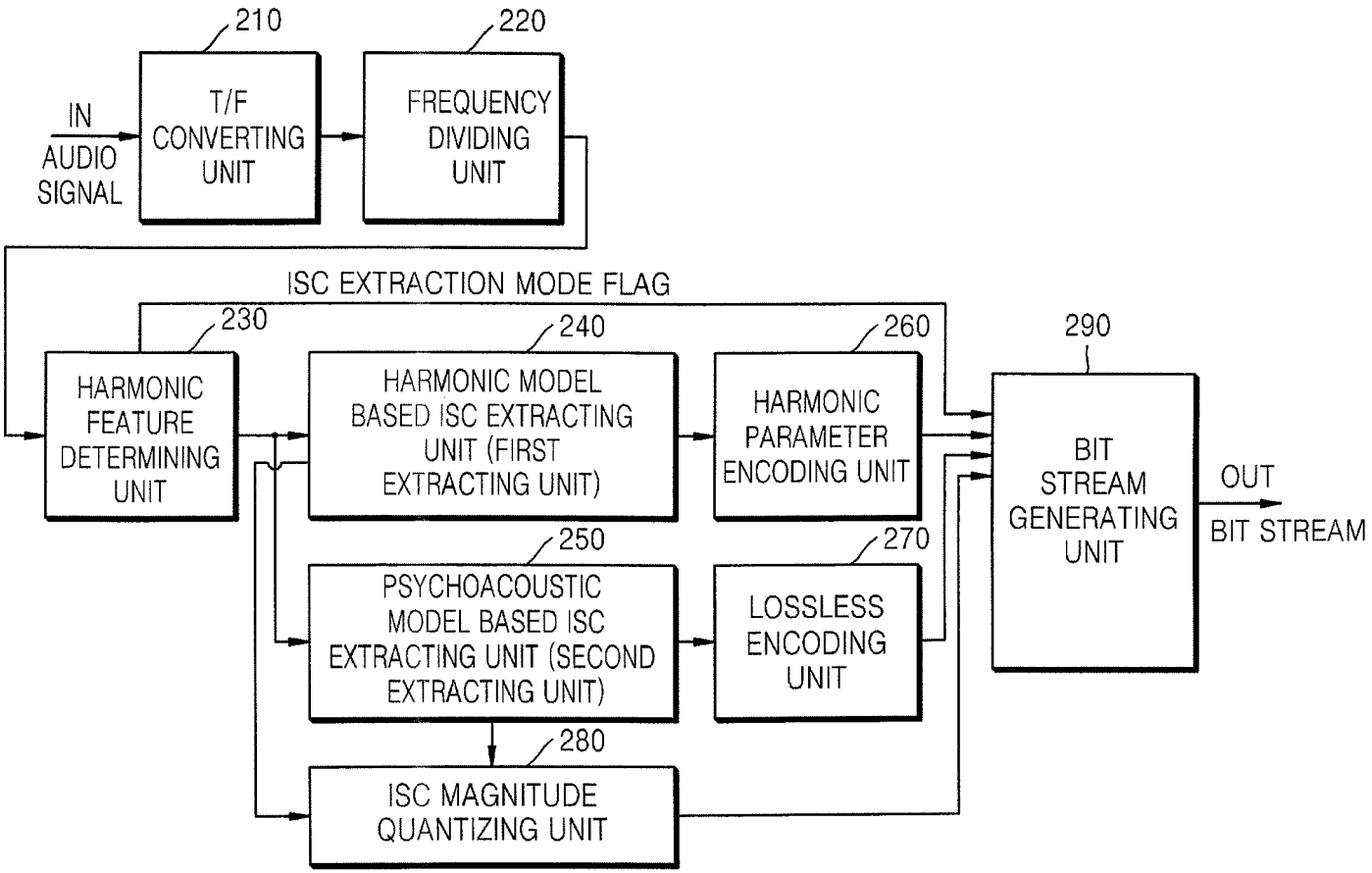
FIG. 2 is a block diagram of an apparatus to encode an audio signal according to an embodiment of the present general inventive concept.

The comparing unit 133 determines whether each of the subbands includes a harmonic feature or not according to the autocorrelation value by performing a comparison test with a threshold value of the autocorrelation value. When the normalized autocorrelation value is larger than a predetermined threshold value, it is determined that the subband includes a harmonic feature, and when the normalized autocorrelation value is smaller than a predetermined threshold value, it is determined that the subband does not include a harmonic feature. A level 1 represents that the subband includes the harmonic feature, and a level 0 represents the subband does not include the harmonic feature. An ISC extracting mode flag as a harmonic feature level is sent to a bit stream generating unit 290, as illustrated in FIG. 2.

The harmonic model based ISC extracting unit 140 extracts an important frequency component from the audio signal having the harmonic feature, and a harmonic parameter from the important frequency component, as IFC (or ISC) information.

The ISC information is extracted by the harmonic model based ISC extracting unit 140 so as to encode information for a position of a frequency component, that is, location coding for the ISC. When an audio signal includes a voice sound, a peak period includes a predetermined feature in a frequency domain. An important frequency component can be specified by using period information of a harmonic peak. Unlike a conventional psychoacoustic model that expresses a position of the important frequency or a value of the important frequency by using bits, an important frequency component can be efficiently specified based on a harmonic model by using period information of a harmonic peak according to the present embodiment.

Additionally, the harmonic model based ISC extracting unit 140 extracts width information in addition to period information of the calculated harmonic peak. A voice signal larger than a minimum audible limit is placed on a region adjacent to a harmonic peak. This can be used to determine an ISC width to extract the width information. The ISC width may be a width between the voice signal and the harmonic peak or between the adjacent frequency peaks.

Although there is no limitation in determining the ISC width, the ISC width can be determined according to a subband so as to select an important frequency component at a harmonic peak common interval included in the corresponding subband. A more detailed method of determining the ISC width will be described later.

The psychoacoustic model based ISC extracting unit 150 calculates a signal to mask ratio (SMR) by considering a psychoacoustic feature for the audio signal of the frequency domain, and extracts a second important frequency component by using the calculated SMR as a second IFC (or second ISC). Here, the IFC (ISC) and the second IFC (ISC) may be collectively referred to as IFC (ISC). A more detailed method of extracting an important frequency component will be described later.

When the second important frequency component is extracted by a psychoacoustic model, a frequency component in a valley portion is not selected as an important frequency component since a harmonic in the valley portion has a small SMR value or energy in a case of a voice signal. However, when a harmonic feature is determined and a harmonic peak period and width information of an important frequency component are extracted from a subband having the harmonic feature, it is possible to encode the valley portion and to simultaneously perform a perceptually excellent decoding of a signal.

FIG. 2 is a block diagram of an apparatus to encode an audio signal according to an embodiment of the present general inventive concept. The apparatus to encode the audio signal illustrated in FIG. 2 may be referred to as an encoder.

The apparatus to extract an important frequency component to encode the audio signal includes an T/F converting unit 210, a frequency dividing unit 220, a harmonic feature determining unit 230, a harmonic model based ISC extracting unit (a first extracting unit) 240, a psychoacoustic model based ISC extracting unit 250 (a second extracting unit), a harmonic parameter encoding unit 260, a lossless encoding unit 270, an ISC magnitude quantizing unit 280, and a bit stream generating unit 290. The apparatus to encode the audio signal includes the apparatus to extract the important frequency component, for example, the T/F converting unit 210, the frequency dividing unit 220, the harmonic feature determining unit 230, the harmonic model based ISC extracting unit (the first extracting unit) 240, the psychoacoustic model based ISC extracting unit 250 (the second extracting unit of the apparatus of FIG. 1 correspond to the time/frequency (T/F) converting unit 110, the frequency dividing unit 120, the harmonic feature determining unit 130, the harmonic model based important spectral component (ISC) extracting unit 140, and the psychoacoustic model based ISC extracting unit 150, respectively, and thus a detailed description of the apparatus to extract the important frequency component will be omitted for conciseness.

Figure 3:
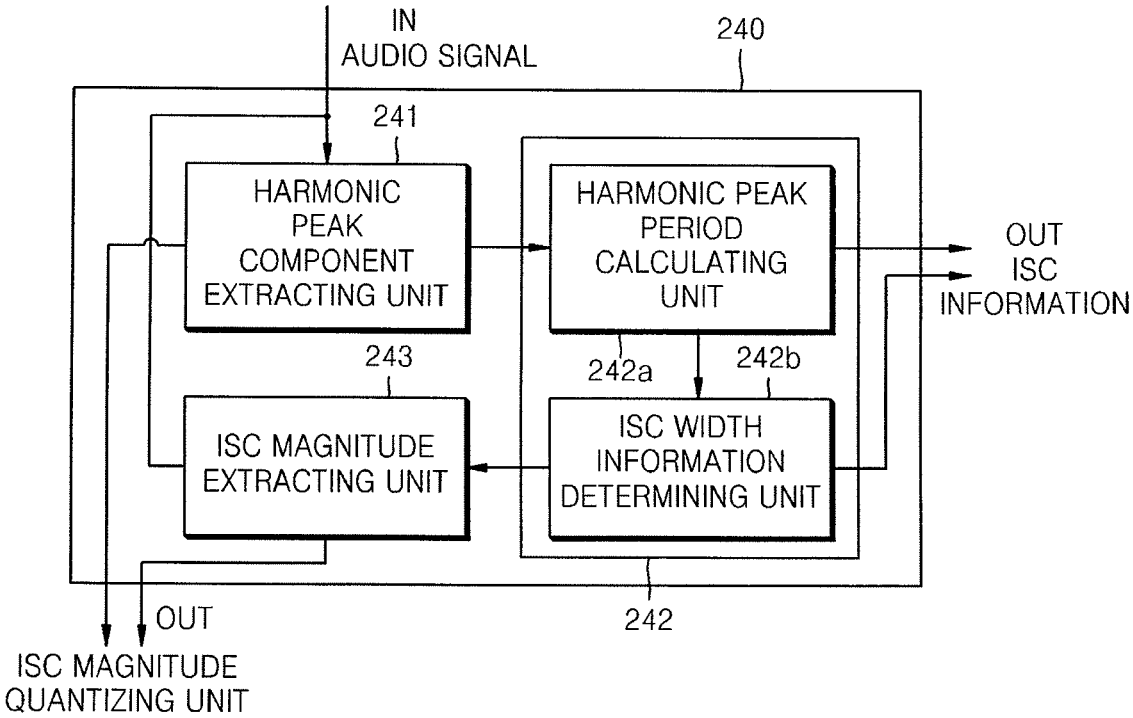
FIG. 3 is a block diagram of an important spectral component (ISC) extractor based on a harmonic model in the apparatus illustrated in FIG. 2.

FIG. 3 is a block diagram of an ISC extractor based on a harmonic model of the apparatus illustrated in FIG. 2. Referring to FIGS. 1 and 2, the harmonic model based ISC extracting unit 240 (the first extracting unit) includes a harmonic peak component extracting unit 241, a harmonic parameter extracting unit 242, and an ISC magnitude extracting unit 243.

The harmonic peak component extracting unit 241 extracts a harmonic peak component from a subband having a harmonic feature. The harmonic peak component includes peak frequency information (or harmonic peak frequency information) on an audio signal magnitude according to the peak frequency, so that harmonic parameter information corresponding to the harmonic feature is generated.

The harmonic parameter extracting unit 242 includes a harmonic peak period calculating unit 242*a* and an ISC width information determining unit 242*b*. The harmonic peak period calculating unit 242*a* calculates a harmonic peak period, that is, a pitch value between the harmonic peaks, by using the harmonic peak frequency information extracted by the harmonic peak component extracting unit 241.

The ISC width information determining unit 242*b* determines width information of an important frequency component by using a period of a harmonic peak frequency, i.e., the peak frequency information, calculated by the harmonic peak period extracting unit 242*a*. There are no specific requirements for a method of determining the width of an important frequency component. For example, the width of an important frequency component can be determined to be in a relationship where the number of harmonic peak components in a subband is inversely proportional to the width of an important frequency component.

The ISC magnitude extracting unit 243 extracts magnitude information of a specified important frequency according to the harmonic peak frequency and the ISC width. The magnitude information extracted from the ISC magnitude extracting unit 243 is quantized through the ISC magnitude quantizing unit 280 according to a predetermined quantized step magnitude.

Figure 4:
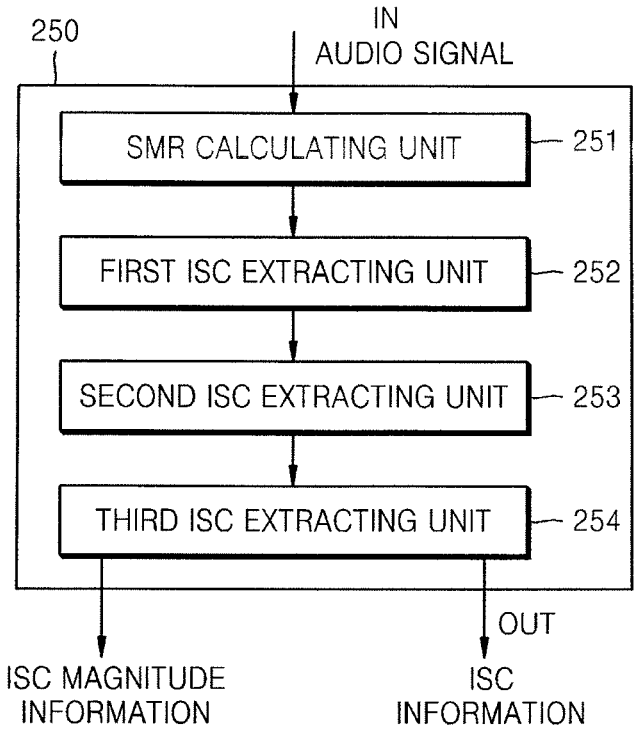
FIG. 4 is a block diagram of an ISC extractor based on a psychoacoustic model in the apparatus illustrated in FIG. 2.

FIG. 4 is a block diagram of an ISC extractor based on a psychoacoustic mode in the apparatus illustrated in FIG. 2. Referring to FIGS. 1, 2, and 4, the ISC extracting unit 250 includes an SMR calculating unit 251, a first ISC extracting unit 252, a second ISC extracting unit 253, and a third ISC extracting unit 254, and generates the ISC information.

The SMR calculating unit 251 calculates an SMR value by considering a psychoacoustic model for the audio signal of the frequency domain. The first ISC extracting unit 252 selects a frequency component larger than a masking threshold from the audio signal of the frequency domain by using the calculated SMR value. The second ISC extracting unit 253 extracts a peak frequency by considering a predetermined weight in the selected frequency component, and selects the extracted peak frequency as an important frequency component. The predetermined weight can be obtained using Equation (1):

$$W_k = \frac{\lfloor SC_k \rfloor}{\sum_{i=k-len}^{k-1} |SC_i| + \sum_{j=k+1}^{k+len} |SC_j|} \tag{1}$$

where $|SC_k|$ represents the magnitude of a current signal obtaining a weight, $|SC_i|$ and $|SC_j|$ are the magnitudes of signals adjacent to the current signal, len represents the number of the current signal and neighboring signals, and i and j are an integer.

The third ISC extracting unit 254 performs signal to noise ratio (SNR) equalization. The third ISC extracting unit 254 calculates a SNR of each frequency band, and selects a frequency component having more than a predetermined magnitude from a frequency band having a low SNR as an important frequency component. The reason for performing the SNR equalization is to prevent intensively selecting important frequencies from a specific frequency band.

In the present embodiment, the ISC extracting unit 250 includes the first ISC extracting unit 251 through to the third ISC extracting unit 253. However, the ISC extracting unit 250 may include one or two of the first, second, and third ISC extracting units 251, 252, and 253 if necessary.

The harmonic parameter encoding unit 260 encodes a harmonic parameter extracted based on a harmonic model and quantized by using a quantizing unit (not shown). The harmonic parameter includes period information of a peak frequency and width information of the important frequency component. The harmonic parameter encoding unit 260 encodes the harmonic parameter information quantized by using the quantizing unit.

The lossless encoding unit 270 performs lossless encoding on the ISC information extracted based on the psychoacoustic model and quantized through a second quantizing unit (not shown). The quantizing unit minimizes additional information of signal by grouping the signals according to a relationship between the amount of used bits and errors to encode the signals, determines a quantizing step magnitude by considering the grouped signal distribution and an SMR value, and then quantizes the grouped signals according to the determined quantizing step magnitude. The lossless encoding unit 270 encodes the quantized signal by context arithmetic coding. The lossless encoding unit 270 encodes a frequency selected as an important frequency component and a frequency not selected as an important frequency component into, for example, 0 and 1, respectively.

The ISC magnitude quantizing unit 280 quantizes the magnitude of an audio signal according to an important frequency component that is extracted by the harmonic model based ISC extracting unit 240 or by the psychoacoustic mode based ISC extracting unit 250.

The bit stream generating unit 290 outputs a bit stream by receiving output information of the lossless encoding unit 270 and the ISC magnitude quantizing unit 280 and information including an ISC extracting mode flag.

When the IFC is selected based on the harmonic model and the ISC is selected based on the psychoacoustic model, the location coding bits of the IFC selected based on the harmonic model can be reduced up to 1/10 of the ISC selected based on the psychoacoustic model. That is, when an important frequency component is extracted by using the harmonic features, more important frequency components can be selected having the same bit rate. Moreover, a harmonic structure in a voice signal can be well maintained, thereby obtaining improved sound quality.

Figure 5:
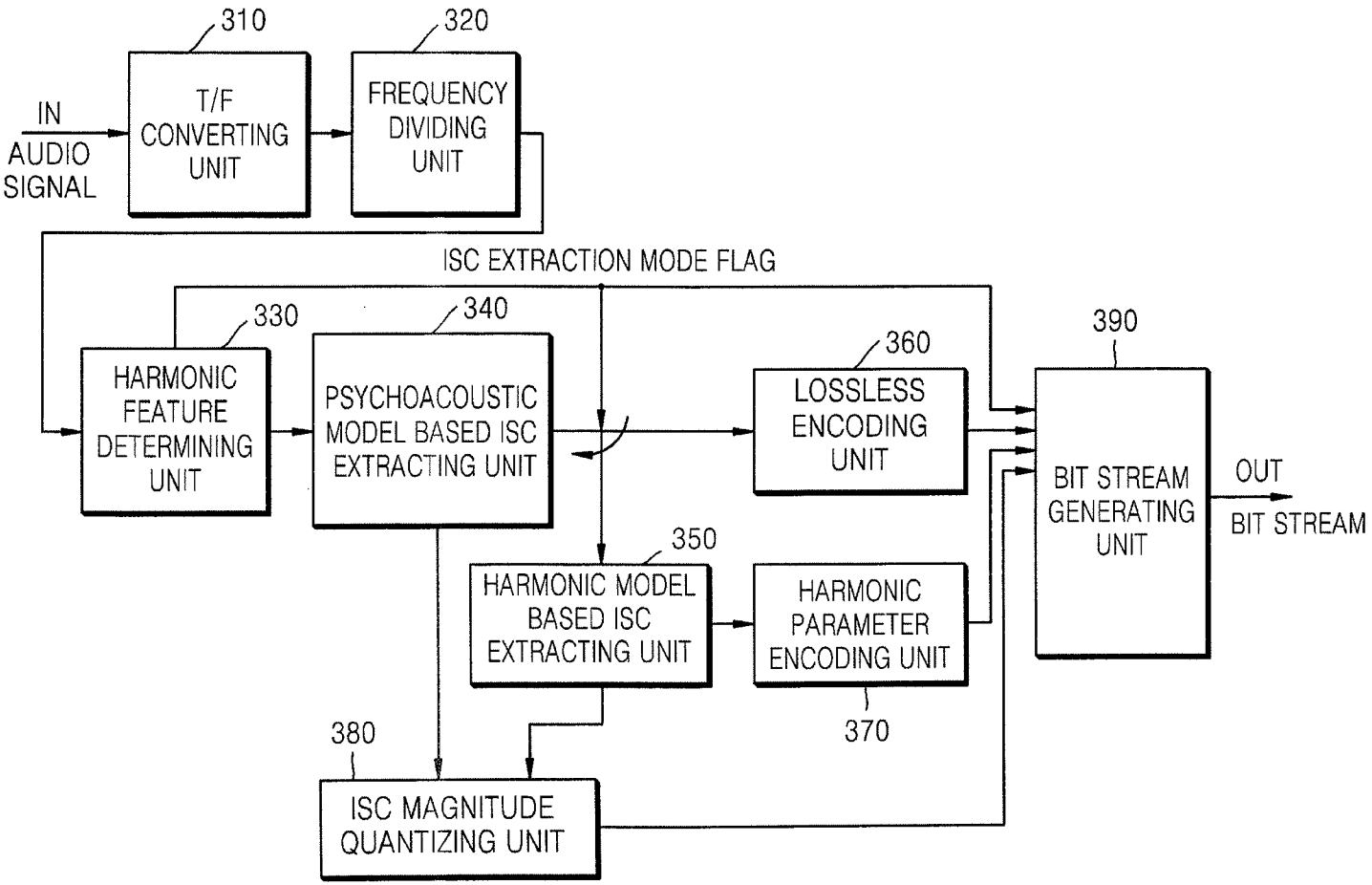
FIG. 5 is a block diagram of an apparatus to encode an audio signal according to another embodiment of the present general inventive concept.

FIG. 5 is a block diagram of an apparatus to encode an audio signal according to another embodiment of the present general inventive concept. The apparatus to encode the audio signal illustrated in FIG. 5 may be referred to as an encoder.

The apparatus to encode the audio signal includes a T/F converting unit 310, a frequency dividing unit 320, a harmonic feature determining unit 330, a harmonic model based ISC extracting unit 340, a psychoacoustic model based ISC extracting unit 350, a harmonic parameter encoding unit 360, a lossless encoding unit 370, an ISC magnitude quantizing unit 380, and a bit stream generating unit 390. Since the apparatus to encode the audio signal includes the important frequency component extracting unit of FIG. 1, for example, the T/F converting unit 310, the frequency dividing unit 320, and the harmonic feature determining unit 330 of FIG. 5 correspond to the time/frequency (T/F) converting unit 110, the frequency dividing unit 120, the harmonic feature determining unit 130 of FIG. 1, respectively, a detailed description thereof will be omitted for conciseness.

The harmonic feature determining unit 330 determines whether a harmonic feature exists or not in a subband unit, and determines which encoding path is used to encode the audio signal. The encoding path include a first path in which the audio signal is encoded according to ISC information of the ISC extracted using a psychoacoustic model and a second path in which the audio signal is encoded according to ISC information of the ISC extracted using a harmonic model.

The psychoacoustic model based ISC extracting unit 340 extracts an important frequency component based on the psychoacoustic model regardless of the ISC extracting mode according to the first path to encode the audio signal received from the harmonic feature determining unit 330.

The encoding apparatus extracts the ISC information based on the psychoacoustic model from the audio signal in a subband that does not include a harmonic feature, and the extracted ISC information is encoded by the lossless encoding unit 360.

The harmonic model based ISC extracting unit 350 extracts a harmonic model parameter by using the ISC information that is previously extracted by using the psychoacoustic model. The extracted harmonic model parameter as the ISC information among the ISC information extracted according to the psychoacoustic model is used to encode the audio signal. That is, the ISC information extracted according to the psychoacoustic model and the harmonic model is used to encode the audio signal. A detailed method of extracting the harmonic model parameter will be described later.

Figure 6:
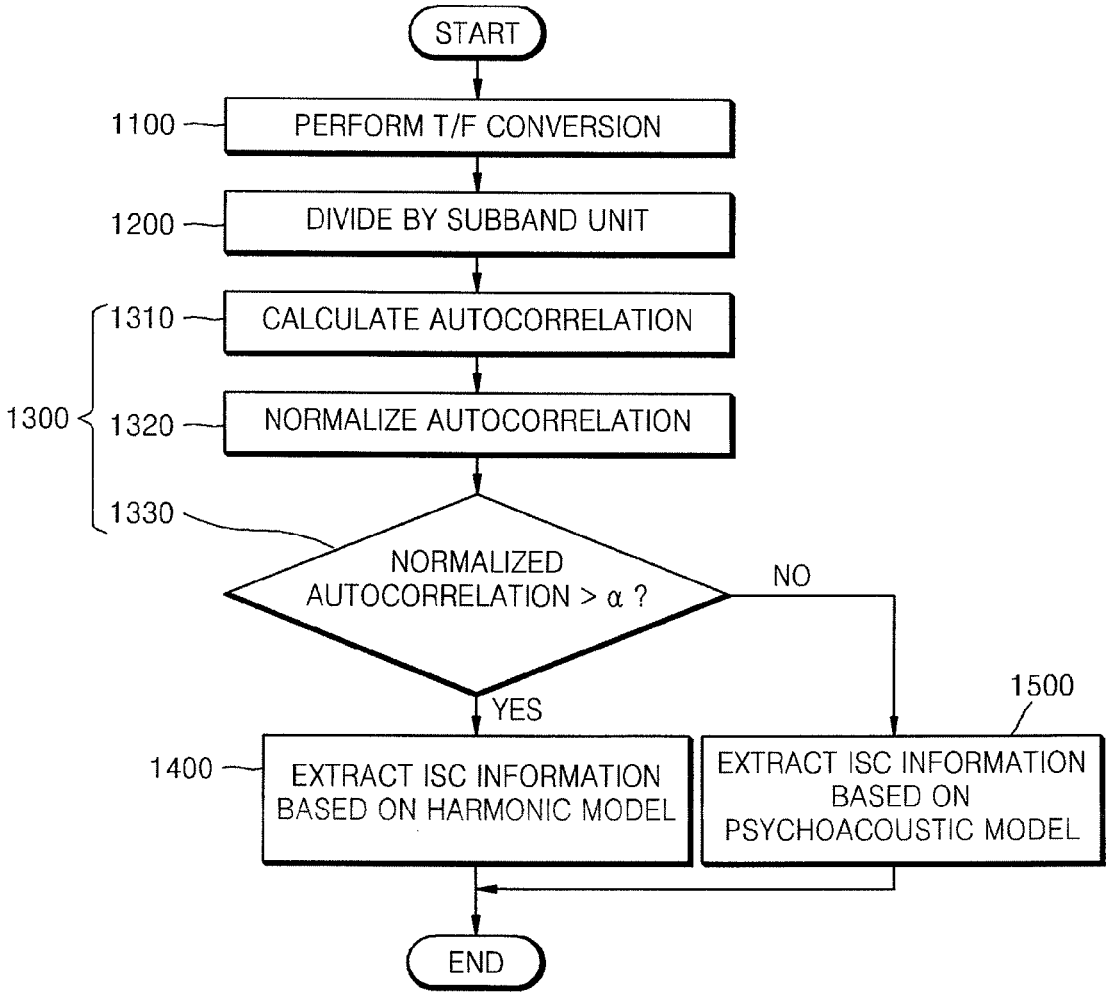
FIG. 6 is a flowchart of a method of extracting an important frequency component of an audio signal according to an embodiment of the present general inventive concept.

FIG. 6 is a flowchart of a method of extracting an important frequency component of an audio signal according to an embodiment of the present general inventive concept.

Referring to FIGS. 1, 2, and 6, in operation S1100, the T/F converting unit 110 divides an input audio signal by a frame, and converts an audio signal of a time domain into an audio signal of a frequency domain. The T/F converting unit 110 performs MDCT and MDST on the audio signal of the time domain to convert the audio signal of the time domain into an audio signal of the frequency domain.

In operation S1200, the frequency dividing unit 120 divides the audio signal of the frequency domain into subbands.

In operation S1300, the harmonic feature determining unit 130 determines whether the harmonic feature exists or not at each subband. Operation S1300 includes operation S1310 through operation S1330.

The harmonic feature determining unit 130 calculates autocorrelation in operation S1310, and the autocorrelation is normalized in operation S1320, and then compared to a predetermined threshold value a in operation S1330.

By using the comparison result of operation S1330, when the normalized autocorrelation value is larger than a predetermined threshold value, the current subband includes a harmonic feature and the ISC information is extracted based on the harmonic model in operation S1400.

The ISC information based on the harmonic model is an important frequency component itself and includes a harmonic parameter (or the harmonic model parameter) extracted from the important frequency component. The harmonic parameter includes location information of an important frequency. The encoding efficiency depends on how to determine location information for important frequency components.

The representative location information includes information for a harmonic peak period. In the case of a voice sound, a distance value between the harmonic peaks needs to be uniformly maintained in a specific subband. Therefore, the harmonic peak period can be used to encode the subbands having a harmonic feature by using a smaller number of bits.

For example, when the harmonic peak period at each subband is encoded, the harmonic frequency period of a subband in a low band can be expressed in 5 to 6 bits, and the next subband can be coded using difference coding with a smaller number of bits.

The harmonic parameter information further includes width information of an important frequency component in addition to a harmonic peak period. The important frequency component includes a harmonic peak and frequency components adjacent to the harmonic peak. The efficient selecting or determining of the ISC width is important in terms of sound quality improvement of the audio signal.

For example, provided is a method of determining the ISC width according to a subband, and obtaining common intervals of all harmonic peaks in the same subband. In this case, although frequency components that are symmetrically placed with respect to the ISC width can be selected, it is possible to select important frequency components that are placed on the left side with respect to the ISC width, which is determined according to the center of each of the harmonic peaks since frequency components are more masked after a harmonic peak is caused by post-masking having a gentler curve than pre-masking.

Provided is another method of widening the ISC width when a harmonic peak period is large, and narrowing the ISC width when the harmonic peak period is small by considering a harmonic peak period according to a subband. That is, the ISC width is changed according to the period of the harmonic peak frequency to have a positive correlation between the period of the harmonic peak frequency and the ISC width.

Additionally, there is a method of adding ISC width information to the harmonic parameter information. For example, the optimal ISC width is determined at each subband by using the ISC width information obtained through the psychoacoustic model and the number of ISCs at each subband. The determined ISC width information is encoded by the subband.

Moreover, an important frequency component is selected based on a harmonic peak by considering a masking threshold, and the number of important frequencies is determined according to each harmonic peak. Then, the number of determined important frequencies is encoded as the ISC width information. In this case, it is better in terms of low bit rate encoding to use a difference coding for an ISC width difference than to encode all the ISC width information according to each harmonic frequency.

By considering a comparison result of operation S1330, when the normalized autocorrelation value is smaller than a predetermined threshold, the ISC information is extracted based on the psychoacoustic model since a corresponding subband does not have a harmonic feature in operation S1500.

In operation S1500, the SMR calculating unit 251 calculates an SMR value by considering a psychoacoustic model for a converted audio signal in a frequency domain. The first ISC extracting unit 252 selects a frequency component larger than a masking inverse value from an audio signal of a frequency domain by using the calculated SMR value. The second ISC extracting unit 253 extracts a peak frequency by considering a predetermined weight in the selected frequency component, and selects the extracted peak frequency as an important frequency component. The third ISC extracting unit 254 performs an SNR equalization. The third ISC extracting unit 254 obtains an SNR at each frequency band, and selects a frequency component having more than a predetermined magnitude from a frequency band having a low SNR as an important frequency component.

Figure 7:
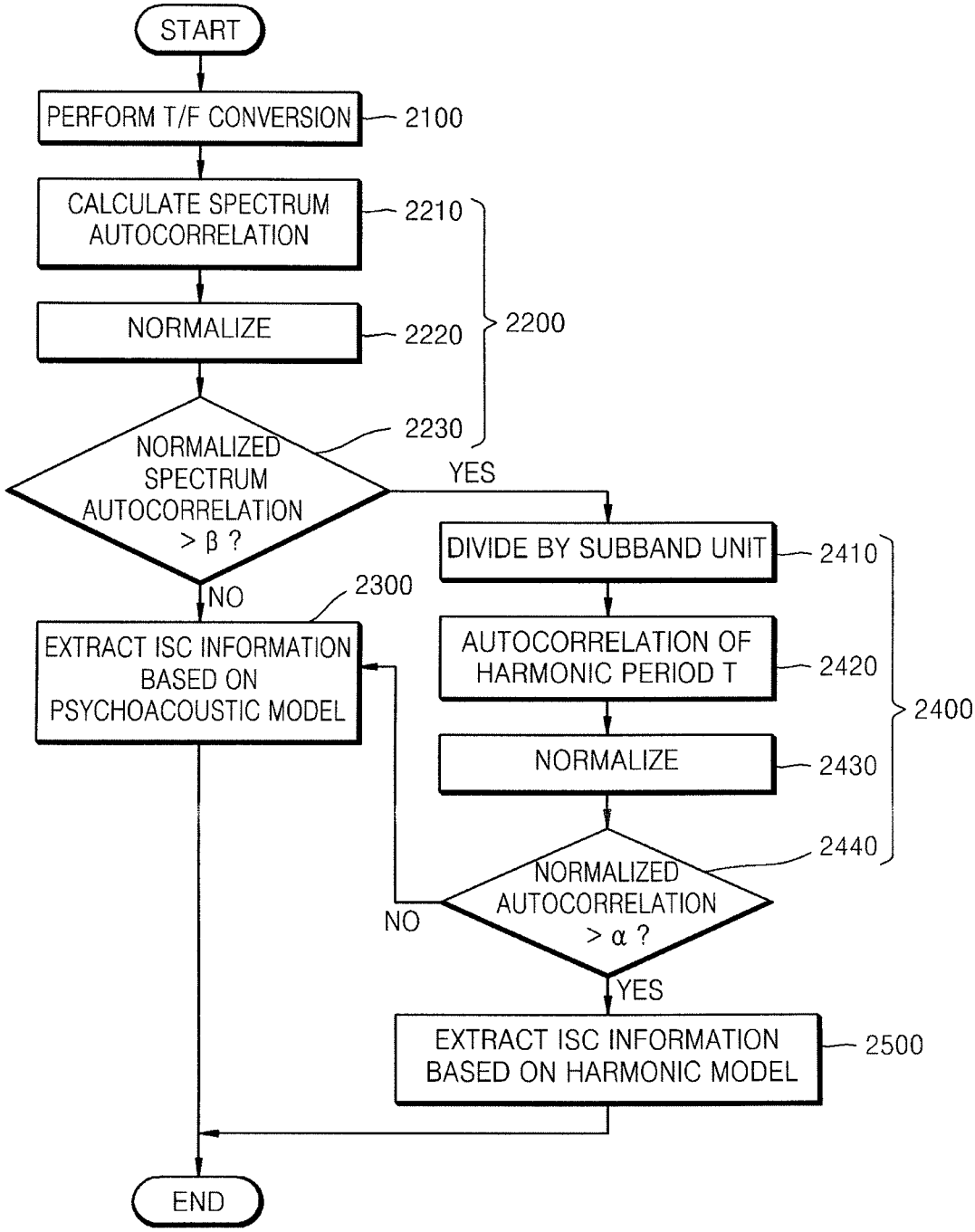
FIG. 7 is a flowchart of a method of extracting an important frequency component of an audio signal according to another embodiment of the present general inventive concept.

FIG. 7 is a flowchart of a method of extracting an important frequency component of an audio signal according to another embodiment of the present general inventive concept.

Referring to FIGS. 1, 2, and 7, in operation S2100, the T/F converting unit 110 divides an input audio signal by a frame, and converts an audio signal of a time domain into an audio signal of a frequency domain.

In operation S2210, a spectral covariance calculating unit (not shown) calculates covariance for an audio signal of a frequency domain using Equation (2). The spectral covariance reflects the intensity of a harmonic feature of each frame of audio signal. As the spectral covariance is larger, the harmonic feature of the corresponding frame is stronger.

$$R_s(\tau) = \frac{\int_0^{\pi-\omega_\tau} \bar{S}_f(\omega)\bar{S}_f(\omega+\omega_\tau)d\omega}{\sqrt{\int_0^{\pi-\omega_\tau} \bar{S}_f\bar{S}_f^2(\omega)d\omega \int_0^{\pi-\omega_\tau} \bar{S}_f\bar{S}_f^2(\omega+\omega_\tau)d\omega}} \quad (2)$$

where $Rs(\tau)$ represents a normalized spectral covariance value according to a harmonic peak period or a harmonic pitch frequency ($\omega_\tau$), Sf represent a signal to be normalized, and $\tau$ represents a period value in a time domain.

In operation 2220, the spectral covariance value calculating unit normalizes the spectral covariance to be in the range from 0 to 1. In operation S2230, the normalized spectral covariance value is compared to a predetermined threshold $\beta$.

By considering the comparison result of operation S2230, when the normalized spectral covariance value is smaller than a predetermine threshold, the ISC information is extracted based on a psychoacoustic model in operation S2300.

By considering the comparison result of operation S2230, when the normalized spectral covariance value is larger than a predetermined threshold, the frequency dividing unit divides an audio signal of a frequency domain according to the current frame into a subband unit in operation S2410, and calculates an autocorrelation value of period T in the harmonic peak frequency by using the subband in operation S2420.

In operation S2430, the autocorrelation value calculating unit 132 normalizes an autocorrelation value. In operation S2440, the normalized autocorrelation value is compared to a predetermined threshold $\alpha$.

By considering a comparison result of operation S2440, when the normalized autocorrelation value is smaller than a predetermined threshold, the ISC information is extracted based on the psychoacoustic model since a corresponding subband does not have a harmonic feature in operation S2300.

By considering a comparison result of operation S2440, when the normalized autocorrelation value is larger than a predetermined threshold, the ISC information is extracted based on the harmonic model since a corresponding subband has a harmonic feature in operation S2500.

Figure 8:
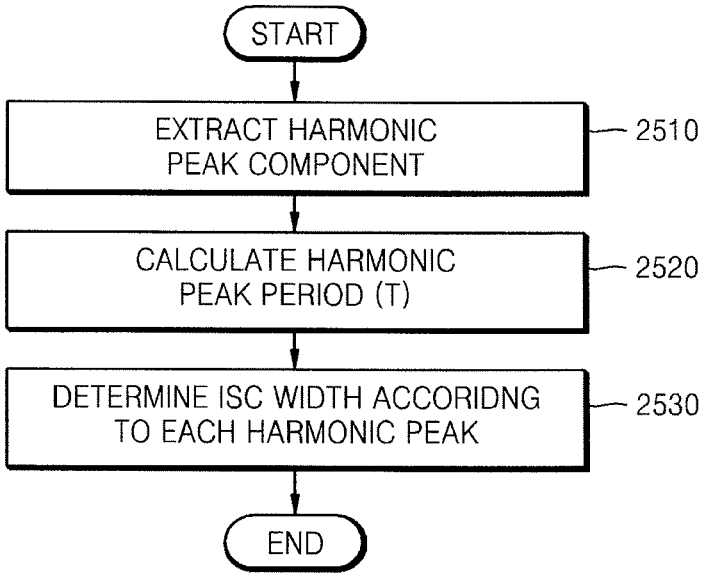
FIG. 8 is a flowchart of a method of extracting ISC information based on a harmonic model according to an embodiment of the present general inventive concept.

FIG. 8 is a flowchart of a method of extracting ISC information based on a harmonic model according to an embodiment of the present general inventive concept.

Referring to FIGS. 1, 2, 3, and 8, in operation S2510, the harmonic peak component extracting unit 241 extracts a harmonic peak component from a corresponding subband, and the harmonic peak period calculating unit 242*a* calculates a harmonic peak period in operation S2520.

In operation S2530, the ISC width information determining unit 242*b* determines the ISC width according to each subband or the width of an important frequency according to each harmonic peak. In operation 2530, the ISC width information determining unit 242*b* extracts ISC width information according to various width information determining methods.

Figure 9:
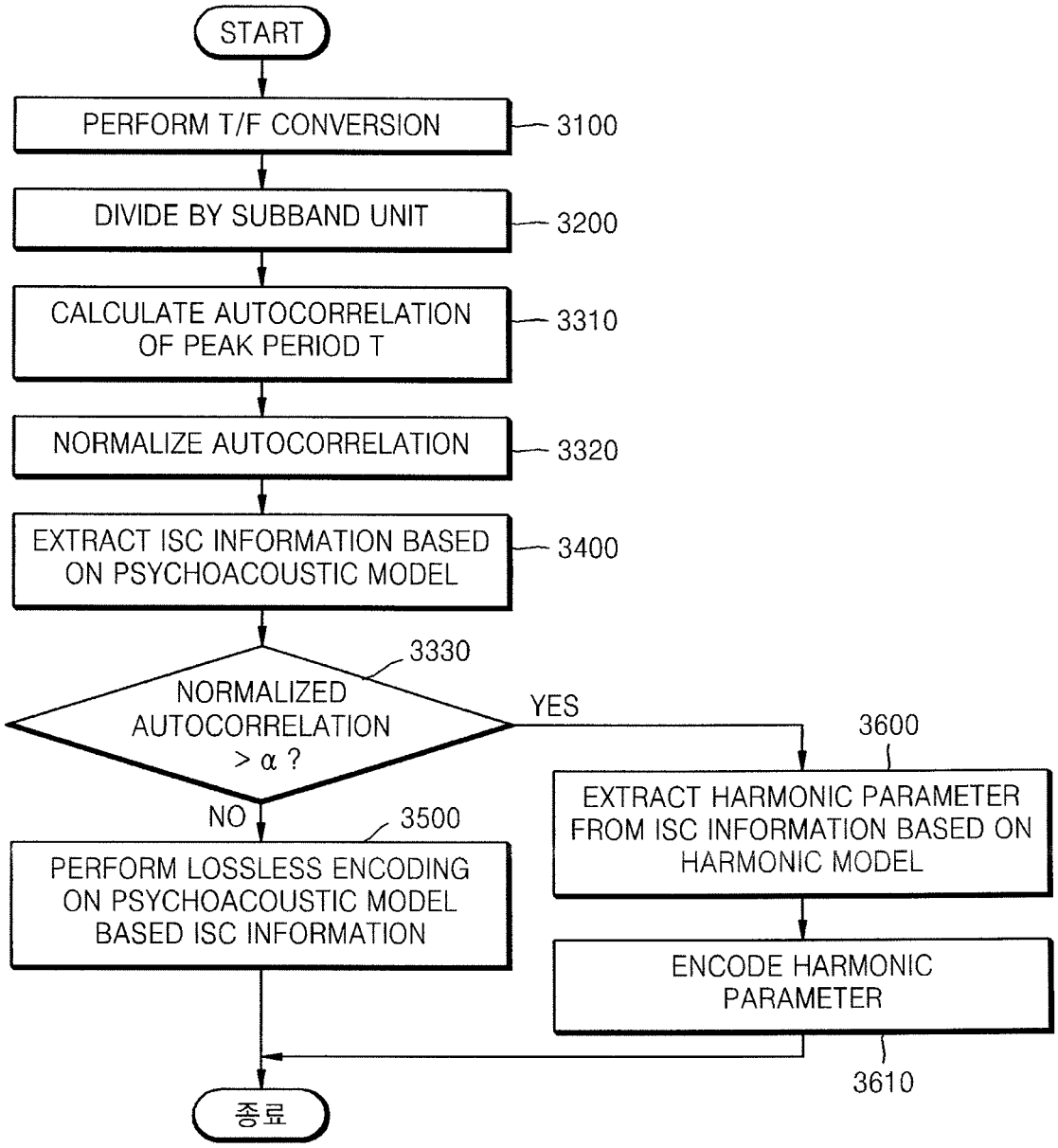
FIG. 9 is a flowchart of a method of encoding an audio signal according to an embodiment of the present general inventive concept.

FIG. 9 is a flowchart of a method of encoding an audio signal according to an embodiment of the present general inventive concept. Since operations 3100 through 3320 of FIG. 9 are similar to operations 1100 through 1320 of FIG. 6, a detailed description thereof will be omitted for conciseness.

Referring to FIGS. 1, 5, and 9, in operation S3400, the psychoacoustic model based ISC extracting unit 250 extracts ISC information based on a psychoacoustic model.

By considering the comparison result of operation 3330, when the normalized autocorrelation value is smaller than a predetermined threshold, the lossless encoding unit 270 performs lossless encoding on the extracted psychoacoustic based ISC information in operation S3500.

By considering the comparison result of operation 3330, when the normalized autocorrelation value is larger than a predetermined threshold, a harmonic parameter is extracted from the extracted ISC information on the basis of a psychoacoustic model in operation S3600. Then, a harmonic parameter is encoded in operation 3610.

In a method of extracting a harmonic parameter by using the extracted important component information on the basis of the psychoacoustic model, a predetermined frequency component is individually selected from frequency components that are larger than a minimum audible limit according to each harmonic peak, and the ISC width information is extracted according to each harmonic peak.

Moreover, the ISC width can be determined by using a number of important frequency components of each extracted subband on the basis of the psychoacoustic model.

First, a harmonic peak in the subband is selected as an important frequency component, and frequency components in the right side (a low frequency band) of the harmonic peak are selected as a frequency component. Frequency components in the left side (a high frequency band) of the harmonic peak are selected as a frequency component. Until the number of important frequency components that are selected is as many as the number of the ISCs according to a subband, they can be selected by repeating the above processes. The width of the important frequency component is automatically determined, and the above method uses information for the number of the ISCs at each subband extracted based on the psychoacoustic model as the ISC width information.

Figure 10:
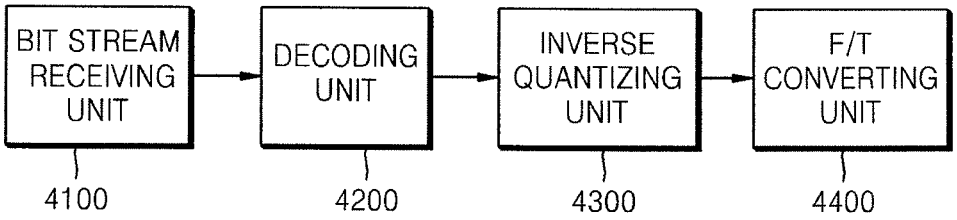
FIG. 10 is a block diagram of an apparatus to decode an audio signal according to an embodiment of the present general inventive concept.

FIG. 10 is a block diagram of an apparatus to decode an audio signal according to an embodiment of the present general inventive concept. The decoding apparatus decodes a low bit rate audio signal encoded by an encoding apparatus of an audio signal, and includes a bit stream receiving unit 4100, a decoding unit 4200, an inverse-quantizing unit 4300, and an F/T converting unit 4400. The encoding apparatus may be the encoder illustrated in FIG. 2 or FIG. 5, and the apparatus of FIG. 10 may be referred to as a decoder.

The bit stream receiving unit 4100 receives ISC information from the encoded bit stream. The ISC information includes period information of a harmonic peak, quantizing step magnitude information, a quantized value of an audio signal, and quantizing information.

The decoding unit 4200 decodes the ISC information from the encoded bit stream and the inverse-quantizing unit 4300 inverse-quantizes the quantized value by using the restored harmonic peak period information, quantizing information, and quantizing step magnitude information.

The F/T converting unit 4400 converts the inverse-quantized value into a signal of a time domain by using the inverse-quantizing unit 4300.

Figure 11:
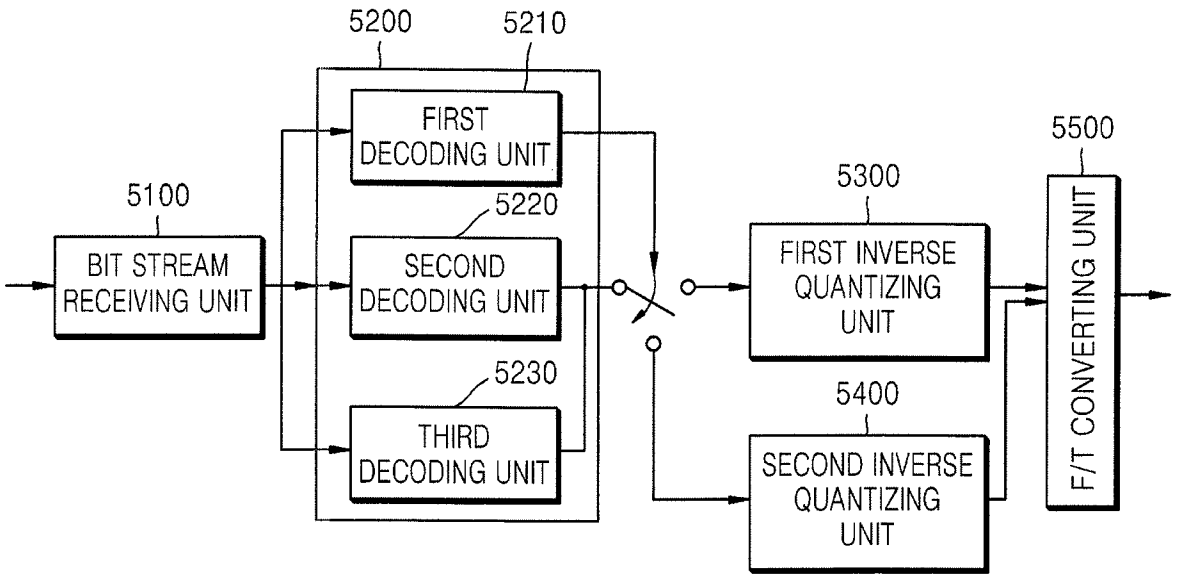
FIG. 11 is a block diagram of an apparatus to decode an audio signal according to another embodiment of the present general inventive concept.

FIG. 11 is a block diagram of an apparatus to decode an audio signal according to another embodiment of the present general inventive concept. The apparatus to decode the audio signal illustrated in FIG. 11 may be referred to as a decoder.

The apparatus to decode the audio signal includes a bit stream receiving unit 5100, a first decoding unit 5210, a second decoding unit 5220, a third decoding unit 5230, a first inverse-quantizing unit 5300, a second inverse-quantizing unit 5400, and an F/T converting unit 5500.

The decoding unit 5200 decodes an audio signal encoded by an encoder based on a harmonic mode or a psychoacoustic model, and includes first, second, and third decoding units. The encoding apparatus may be the encoder illustrated in FIG. 2 or FIG. 5.

The first decoding unit 5210 decodes ISC (important frequency component) extracting mode information from the encoded bit stream. The extracting mode information is used to distinguish an audio signal encoded based on a harmonic model from an audio signal encoded based on a psychoacoustic model. The ISC extracting mode information may be the ISC extracting mode flag illustrated in FIG. 2 or FIG. 5.

The second decoding unit 5220 decodes period information of a harmonic peak or index information representing whether the ISC exists or not from the encoded bit stream. The information decoded by the second decoding unit is location information of an important frequency component.

The third decoding unit 5230 decodes quantized step magnitude information, quantized information, and a quantized value of an audio signal from the encoded bit stream.

The first quantizing unit 5300 inverse-quantizes a quantized value of the audio signal by using the harmonic peak information decoded by the second decoding unit and the quantizing step magnitude information decoded by the third decoding unit according to the ISC extracting mode information restored through the first decoding unit.

The second quantizing unit 5400 inverse-quantizes a quantized value of the audio signal by using index information representing whether the ISC exists or not, which is restored by the second decoding unit, the quantizing step magnitude information, and the quantizing information restored by the third decoding unit according to the ISC extracting mode information that is restored by the first decoding unit.

According to the present general inventive concept, an important frequency component is extracted on the basis of a harmonic model for an audio signal in a frequency band having a harmonic feature, and then encoded and decoded. Also, since the important frequency component is selected according to the harmonic model, an important valley having a low SMR or energy can be selected as the ISC to provide a perceptually improved excellent audio signal. Thus, it is possible to select more important frequency components at the same bit rate. Since a harmonic structure having a voice signal can be well maintained, perceptually enhanced high-quality audio signal can be restored.

The embodiments of the present general inventive concept can be embodied as computer programs on a computer-readable medium and can also be implemented in, for example, general-use digital computers that execute the programs using the computer-readable medium. The computer-readable medium can include a computer-readable recording medium to store the computer program and a computer-readable transmission medium to transmit the computer program.

Examples of the computer readable medium include magnetic storage media (e.g., ROM, floppy disks, hard disks, etc.), optical recording media (e.g., CD-ROMs, or DVDs), and storage media. The general inventive concept can also be embodied as computer-readable codes on a computer-readable medium. The computer-readable medium can include a computer-readable recording medium to store the computer-readable codes and a computer-readable transmission medium to transmit the computer-readable codes. The computer-readable medium is any data storage device that can store data which can be thereafter read by a computer system. Examples of the computer-readable recording medium include read-only memory (ROM), random-access memory (RAM), CD-ROMs, magnetic tapes, floppy disks, optical data storage devices, and so on. The computer-readable recording medium can also be distributed over network-coupled computer systems so that the computer-readable code is stored and executed in a distributed fashion. The computer readable transmission medium can transmit carrier waves and signals (e.g., wired or wireless data transmission through the Internet. Also, functional programs, codes, and code segments for accomplishing the present general inventive concept can be easily construed by programmers skilled in the art to which the present general inventive concept pertains.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of extracting an important frequency component of an audio signal, the method comprising:

converting an audio signal of a time domain into an audio signal of a frequency domain, via a processor;

selecting a frequency band having a harmonic feature from the converted audio signal of the frequency domain; and extracting an important frequency component from the selected frequency band having the harmonic feature and calculating a harmonic peak period from the extracted important frequency component.

2. The method of claim 1, further comprising dividing the converted audio signal of the frequency domain into subbands during the converting of the audio signal of the time domain, and wherein the selecting of the frequency band comprises analyzing the harmonic feature according to each of the subbands to select any subband among the subbands having a harmonic feature.

3. The method of claim 2, wherein the analyzing of the harmonic feature comprises analyzing an autocorrelation of a peak period according to each of the subbands.

4. The method of claim 2, further comprising extracting the important frequency component from each of the divided subbands based on a psychoacoustic model, wherein the extracting of the important frequency component comprises extracting an important frequency component having the harmonic feature by using the important frequency component extracted based on the psychoacoustic model.

5. A method of extracting an important frequency component of an audio signal, the method comprising:

converting an audio signal of a time domain into an audio signal of a frequency domain, via a processor;

dividing the audio signal of the frequency domain into subbands according to a predetermined reference, and determining whether each of the subbands has a harmonic feature or not;

extracting an important frequency component based on a harmonic model from the audio signal of the subband having the harmonic feature according to the determination result, and calculating a harmonic peak period from the extracted important frequency component; and extracting an important frequency component based on a psychoacoustic model from the audio signal of the subband not having the harmonic feature according to the determination result.

6. An apparatus for extracting an important frequency component of an audio signal, the apparatus comprising:

a processor;

a signal converting unit to convert an audio signal of a time domain into an audio signal of a frequency domain;

a harmonic feature determining unit to determine which frequency band of the converted audio signal has a harmonic feature;

a first extracting unit to extract an important frequency component based on a harmonic model from the audio signal of the frequency band the having the harmonic feature; and a second extracting unit to extract an important frequency component based on a psychoacoustic model from the audio signal of the frequency band not having the harmonic feature, wherein the first extracting unit comprises:

a harmonic peak component extracting unit to extract a harmonic peak component from the audio signal of the frequency band having the harmonic feature; and a harmonic peak period calculating unit to calculate a harmonic peak period by using the extracted harmonic peak component.

7. The apparatus of claim 6, further comprising a frequency dividing unit dividing the audio signal of the frequency domain into subbands, wherein the harmonic feature determining unit determines whether the audio signal of the frequency domain includes a harmonic feature or not at each of the subbands.

8. The apparatus of claim 7, wherein the harmonic feature determining unit comprises:

a peak detecting unit to detect a peak component of the audio signal;

an autocorrelation calculating unit to calculate an autocorrelation for a period of the detected peak component at each subband; and a comparing unit to compare the calculated autocorrelation value to a predetermined reference value to determine whether the harmonic feature exists or not at each of the subbands.

9. The apparatus of claim 7, wherein the first extracting unit extracts components of the peak frequency and neighboring frequencies from the frequency domain having the harmonic feature as an important frequency component.

10. The apparatus of claim 7, wherein the first extracting unit further comprises a width information extracting unit extracting width information of the important frequency component extracted based on the harmonic model.

11. The apparatus of claim 10, wherein the period of the harmonic peak and the width of the important frequency component have respectively different negative correlations.

12. A method of encoding an audio signal, the method comprising:

converting an audio signal of a time domain into an audio signal of a frequency domain, via a processor;

selecting a frequency band having a harmonic feature from the converted audio signal of the frequency domain;

extracting an important frequency component having the harmonic feature from the selected frequency band having the harmonic feature;

extracting a harmonic parameter from the important frequency component, the harmonic parameter including period information of a harmonic peak of the important frequency component; and encoding an audio signal by using the extracted harmonic parameter.

13. The method of claim 12, further comprising dividing the converted audio of the frequency domain into subbands during the converting of the audio signal, wherein the selecting of the frequency band comprises:

determining whether the harmonic feature exists or not at each of the subbands; and selecting the subband having the harmonic feature as a frequency band having the harmonic feature.

14. The method of claim 13, wherein the determining of whether the harmonic feature exists or not comprises using an autocorrelation for a peak period at each subband.

15. The method of claim 12, wherein the important frequency component during the extracting of the important frequency component comprises a peak frequency component in the subband having the harmonic feature and neighboring components.

16. The method of claim 12, further comprising:

dividing the converted audio signal of the frequency domain into subbands; and selecting a important frequency component based on psychoacoustic model from the audio signal divided by the subband during the converting of the audio signal, wherein the extracting of the important frequency component is performed using the important frequency component selected based on the psychoacoustic model.

17. The method of claim 12, wherein the harmonic parameter further comprises width information of the important frequency component.

18. The method of claim 17, wherein the period of the harmonic peak and the width of the important frequency component have respectively different negative correlations.

19. The method of claim 12, wherein the encoding of the audio signal further comprises magnitude information of the important frequency component extracted during the extracting of the important frequency component.

20. A method of decoding an audio signal, the method comprising:

decoding information including period information of a harmonic peak, quantizing step magnitude information, and a quantized value of an audio signal;

inverse-quantizing the quantized value of the audio signal by using the decoded information; and converting the inverse-quantized value into a signal of a time domain.

21. A method of decoding an audio signal, the method comprising:

decoding ISC (important spectrum component) extracting mode information, information including a quantized step magnitude information and a quantized value of an audio signal, period information of a harmonic peak, and index information representing whether an ISC exists or not from an encoded bit stream;

inverse-quantizing the quantized value of the audio signal by using the decoded information according to the ISC extracting mode information; and converting the inverse-quantized value into a signal of a time domain.

* * * * *